US007520228B2

(12) United States Patent
Mangano et al.

(10) Patent No.: US 7,520,228 B2
(45) **Date of Patent: *Apr. 21, 2009**

(54) MODULAR FOLDING TABLES

(75) Inventors: Joy Mangano, St. James, NY (US); Brian Scevola, Bohemia, NY (US)

(73) Assignee: Ingenious Designs LLC, Edgewood, NY (US)

( * ) Notice: Subject to any disclaimer, the term of this patent is extended or adjusted under 35 U.S.C. 154(b) by 199 days.

This patent is subject to a terminal disclaimer.

(21) Appl. No.: 11/293,640

(22) Filed: Dec. 2, 2005

(65) Prior Publication Data

US 2006/0185566 A1 Aug. 24, 2006

Related U.S. Application Data

(63) Continuation-in-part of application No. 10/980,222, filed on Nov. 3, 2004.

(51) Int. Cl.
*A47B 3/00* (2006.01)
*A47B 57/00* (2006.01)

(52) U.S. Cl. ..... 108/115; 108/64

(58) Field of Classification Search ..... 108/59, 108/64, 49, 162, 179

See application file for complete search history.

(56) References Cited

U.S. PATENT DOCUMENTS

| | | | | | |
|---|---|---|---|---|---|
| 1,569,697 | A * | 1/1926 | Barclay | 292/126 |
| 2,836,475 | A * | 5/1958 | Sapp | 108/64 |
| 2,873,134 | A * | 2/1959 | Ahlgren | 292/111 |
| 2,997,323 | A * | 8/1961 | Riser | 292/111 |
| 3,915,100 | A * | 10/1975 | Sullivan | 108/64 |
| 5,182,996 | A * | 2/1993 | Gutgsell | 108/64 |
| 5,678,948 | A * | 10/1997 | White | 403/321 |
| 7,008,027 | B2 * | 3/2006 | Kelley et al. | 312/107 |

FOREIGN PATENT DOCUMENTS

DE 3610232 A1 * 10/1987

* cited by examiner

*Primary Examiner*—Janet M Wilkens
*Assistant Examiner*—Timothy M Ayres
(74) *Attorney, Agent, or Firm*—Galgano & Associates, PLLC

(57) ABSTRACT

Folding modular tables include a square table top and hinged vertical supports with hinged horizontal feet. Four coupling members are arranged under the table top, three of one gender and one of the other gender. Two preferred embodiments are provided: one has three male coupling members and one female, the other has three female and one male. By providing these two embodiments, the tables can be coupled to each other in a variety of configurations with the vertical supports and horizontal feet all aligned in such a way as to facilitate the placement of chairs under the table tops.

10 Claims, 15 Drawing Sheets

MODULAR FOLDING TABLES

RELATED APPLICATION

This application is a continuation-in-part of application Ser. No. 10/980,222 filed Nov. 3, 2004.

BACKGROUND OF THE INVENTION

1. Field of the Invention

The invention relates to folding tables. More particularly, the invention relates to modular folding tables which can be connected to each other in a variety of configurations.

2. Brief Description of the Prior Art

Modular tables have been known in the art for many years. Some of these tables are designed to be used with chairs and some are not. With regard to the tables intended to be used with chairs, the location of the table legs becomes an issue. It is important that the table legs be arranged so as to allow a chair to be pulled up underneath the table. This is not so difficult with a single table but with modular connecting tables, it can become a challenge.

SUMMARY OF THE INVENTION

It is therefore an object of the invention to provide modular folding tables.

It is also an object of the invention to provide modular folding tables which have leg arrangements that permit chairs to be pulled up under the tables.

It is another object of the invention to provide modular folding tables which can be connected to each other in a number of different configurations.

Certain of the foregoing and related objects are also attained in a modular table, comprising a square table top; at least one vertical support coupled to said table top; and four coupling members, each being centrally located adjacent an edge of said table top, three of said coupling members being of one gender and one being of the other gender.

Most desirably, said at least one vertical support includes two vertical supports coupled off center to said table top. The vertical supports are preferably hingedly coupled to said table top. Most advantageously, the table includes two horizontal feet, one coupled to each vertical support. Most desirably, the feet are hingedly coupled to said vertical supports. Preferably, the table further includes at least one cross member coupling said vertical supports to each other and at least one cross member coupling said feet to each other. The table advantageously further comprises four folding struts, one coupling each vertical support to said table top and one coupling each foot to a respective vertical support.

In a preferred embodiment, the tables include a square top hingedly coupled to a pair of vertical supports close to one side of the square top and a pair of horizontal feet hingedly coupled to the bottom of the vertical supports and extending substantially the entire width of the table top. The vertical supports are preferably coupled to each other by at least one cross member as are the horizontal feet. A pair of folding struts are coupled between the table top and the vertical supports and a similar pair of struts are coupled between the vertical supports and the horizontal feet. When the struts are folded, the table top and horizontal feet can be folded toward the vertical supports resting substantially parallel thereto, forming a more compact configuration for storage.

According to a preferred embodiment of the invention, table coupling members are centrally located under each edge of the table top. The table coupling members are either male or female and two table embodiments are provided. In one embodiment, the table top is provided with three female coupling members and one male coupling member. In the other embodiment, the table top is provided with three male coupling members and one female coupling member. By providing these two embodiments, the tables can be coupled to each other in a variety of configurations with the vertical supports and horizontal feet all aligned in such a way as to facilitate the placement of chairs under the table tops. Four types of table configurations are shown as examples: straight line, square, L-shape and T-shape. Further according to the invention, the tables are sold in a set of four, two of each embodiment, and, optionally, a set of table cloths for each of several configurations are included with the set.

In a further preferred embodiment, a modular table kit is provided which includes a plurality of tables of a first type and at least one table of a second type, said tables of said first type having a square table top, at least one vertical support coupled to said table top, and four coupling members, each being centrally located adjacent an edge of said table top, three of said coupling members being of a first gender and one being of a second gender; and said tables of said second type having a square table top, at least one vertical support coupled to said table top, and four coupling members, each being centrally located adjacent an edge of said table top, one of said coupling members being of the first gender and three being of the second gender. Preferably the kit further comprises a plurality of table cloths, each being seamed to neatly fit a different configuration of said tables coupled together. Advantageously, with regard to all of the tables, said at least one vertical support includes two vertical supports mounted off center. Desirably each vertical support has a horizontal foot, each vertical support is hingedly coupled to a respective table top, and each foot is hingedly coupled to a respective vertical support. Most advantageously, the kit further comprises with regard to each table, four folding struts, one coupling each vertical support to the table top and one coupling each foot to a respective vertical support. Most desirably, the kit further comprises with regard to each table, at least one cross member coupling vertical supports to each other and with regard to each table, at least one cross member coupling the feet to each other.

DETAILED DESCRIPTION

Figure 1:
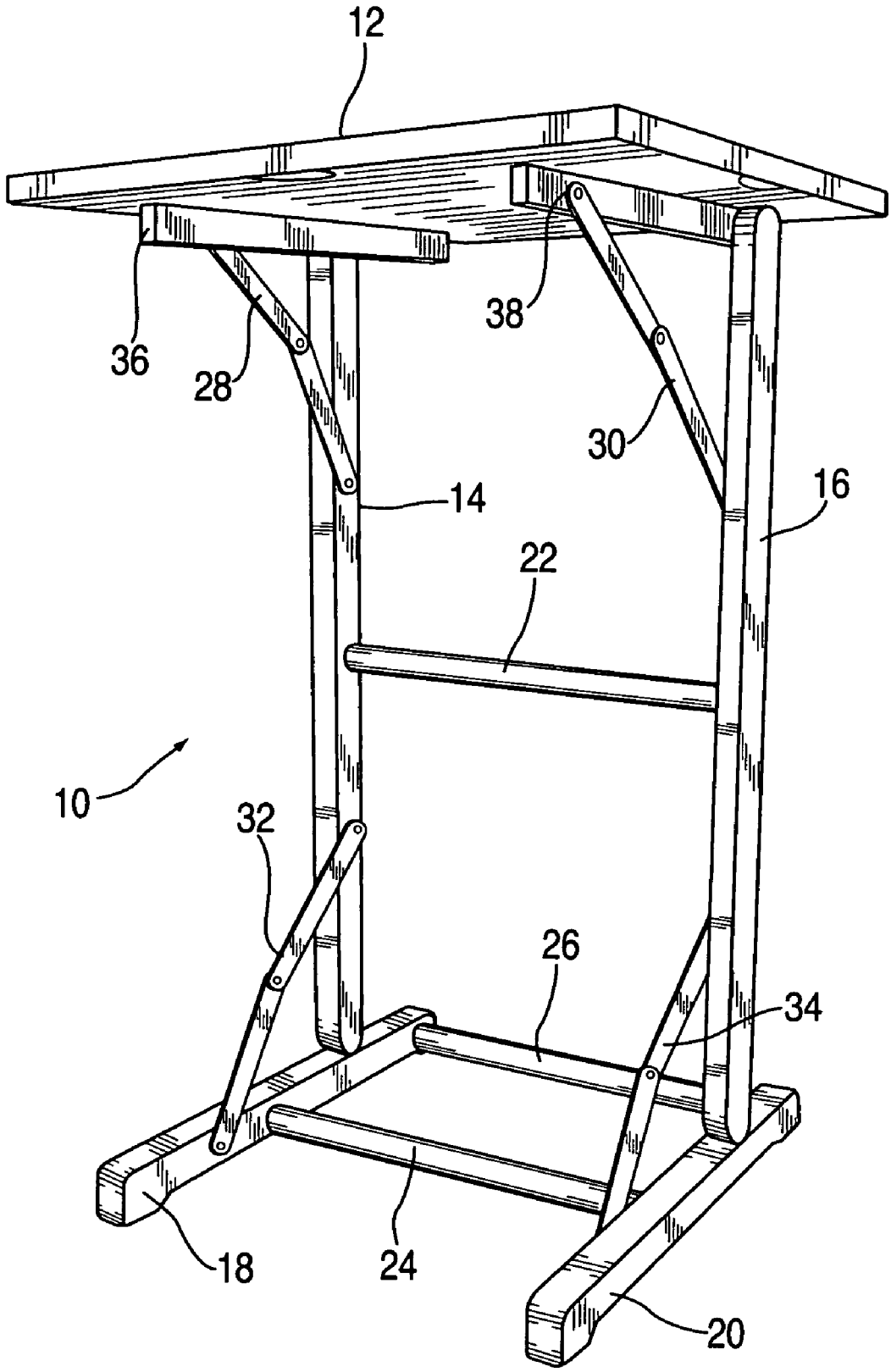
FIG. 1 is a perspective view of a table according to the invention.
Figure 2:
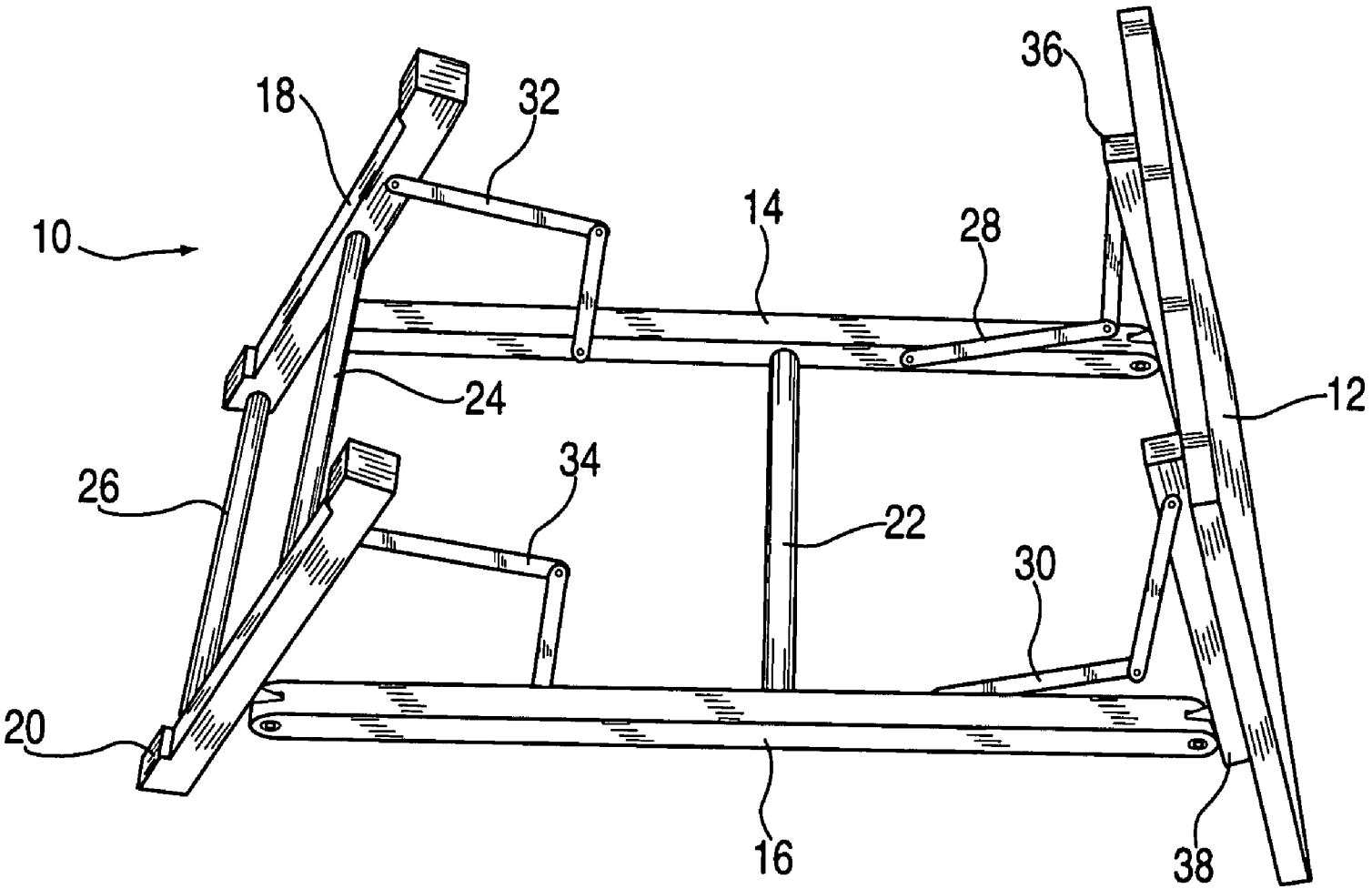
FIG. 2 is a perspective view of the table partially folded.
Figure 3:
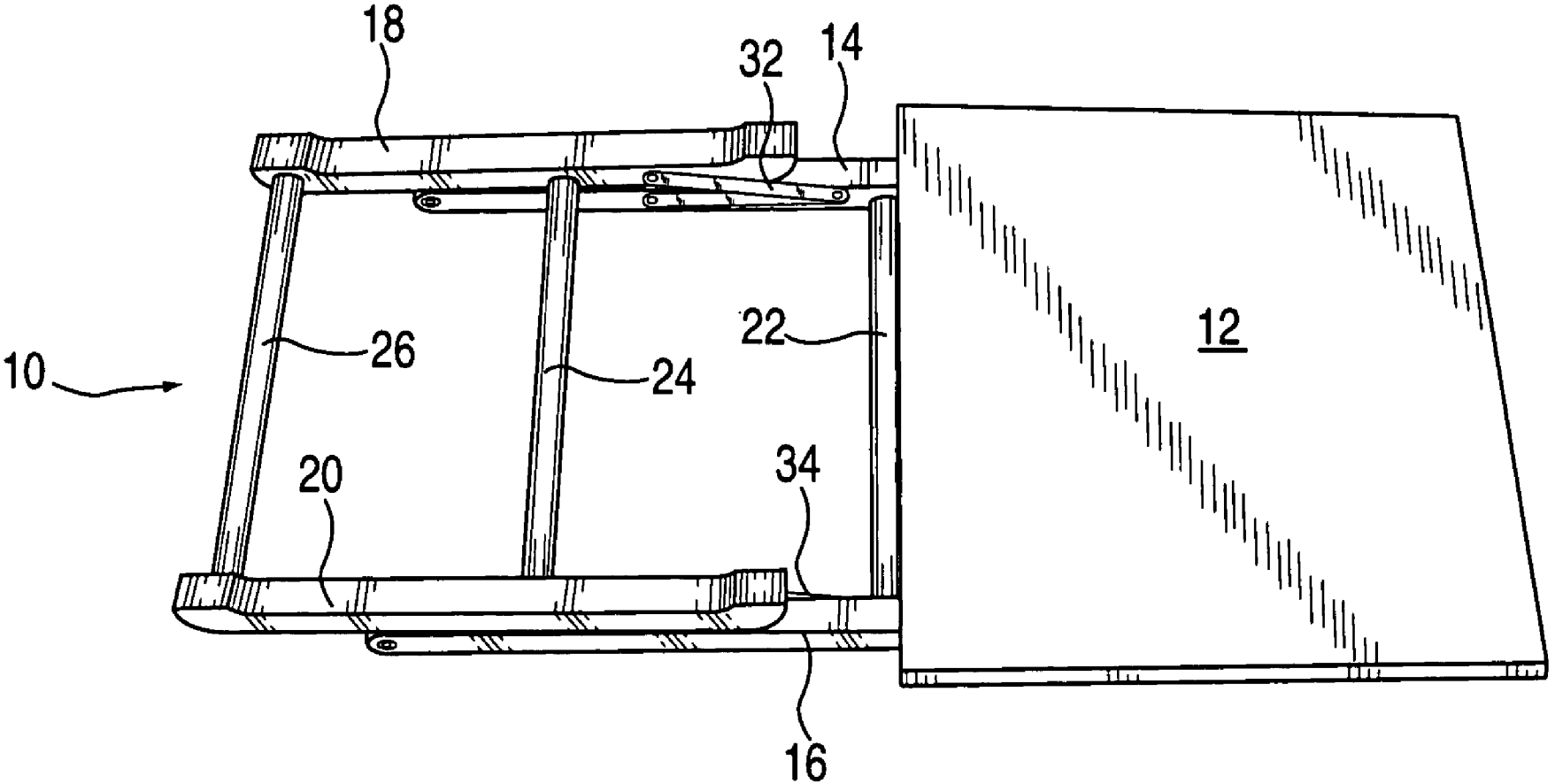
FIG. 3 is a perspective view of the table completely folded.

Turning now to FIGS. 1-3, a table 10 according to the invention includes a square top 12 hingedly coupled to a pair of vertical supports 14, 16 close to one side of the square top 12 and a pair of horizontal feet 18, 20 hingedly coupled to the bottom of the vertical supports 14, 16 and extending substantially the entire width of the table top. The vertical supports 14, 16 are preferably coupled to each other by at least one cross member 22 and the horizontal feet 18, 20 are preferably coupled to each other by two cross members 24, 26. A pair of folding struts 28, 30 are coupled between the table top 12 and the vertical supports 14, 16 and a similar pair of struts 32, 34 are coupled between the vertical supports 14, 16 and the horizontal feet 18, 20. As illustrated, the vertical supports 14, 16 and the folding struts 28, 30 are coupled to the table top 12 via a pair of perpendicular table top supporting members 36, 38.

As seen in FIGS. 2 and 3, when the struts 28, 30, 32, 34 are folded, the table top 12 and horizontal feet 18, 20 can be folded toward the vertical supports 14, 16 resting substantially parallel thereto, forming a more compact configuration for storage.

Figure 4:
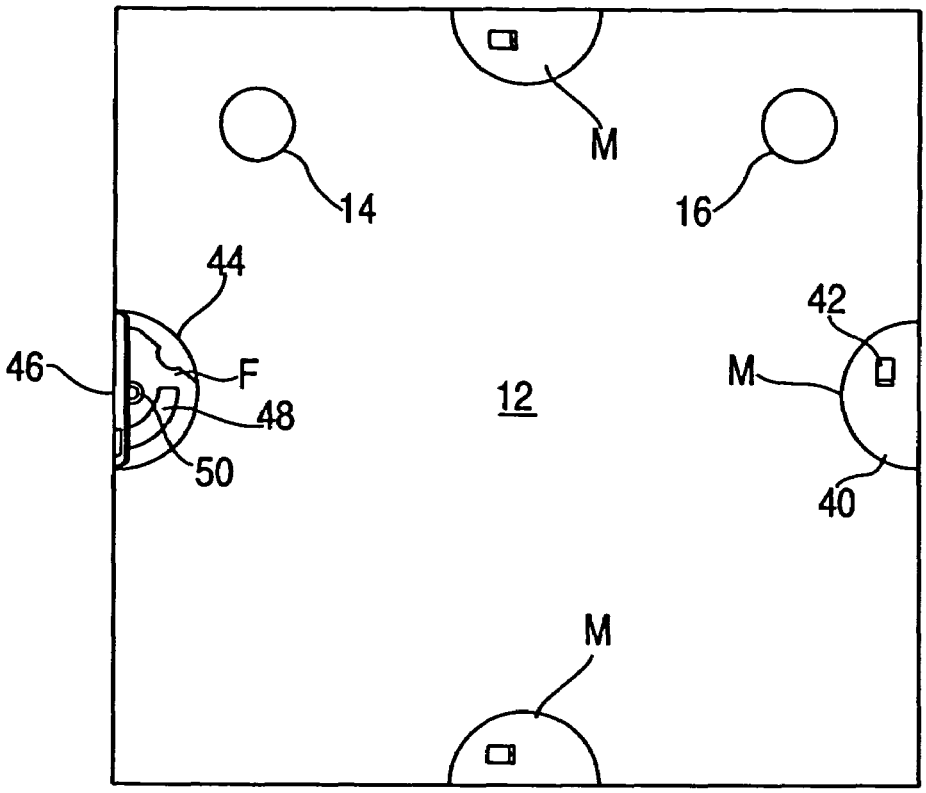
FIG. 4 is a transparent plan view of a first embodiment of a table according to the invention.

According to the invention table coupling members are centrally located under each edge of the table top. The table coupling members are either male or female and two table embodiments are provided. FIG. 4 illustrates one embodiment where the table top 12 is provided with three male coupling members M and one female coupling member F. As illustrated, the male coupling member M comprises a semicircular plate 40 which has been punched and bent to exhibit an upstanding central flange 42. The female coupling member 44 is a semicircular plate 44 which has been punched and bent to exhibit an upstanding edge flange 46 and a curved slot 48. The female coupling member F is rotatable about a pivot 50.

Figure 5:
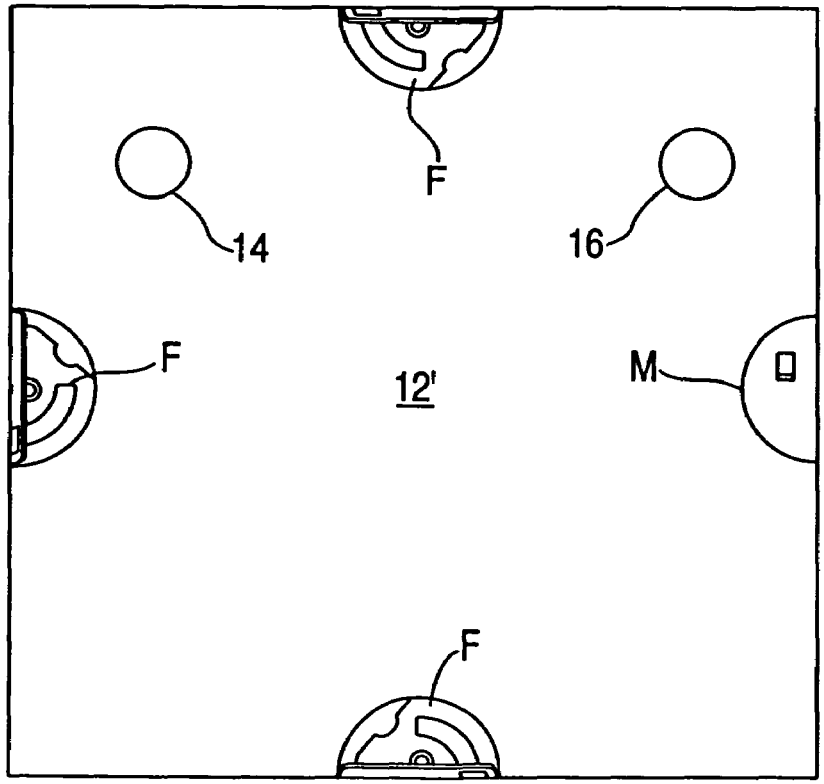
FIG. 5 is a transparent plan view of a second embodiment of a table according to the invention.

FIG. 5 illustrates the other embodiment of a table according to the invention where the table top 12' is provided with three female coupling members F and one male coupling member M. Although a particular male and female coupling member construction has been shown, it will be appreciated that different types of male and female coupling members could be used so long as there are three of one gender and one of the other gender.

Figure 6:
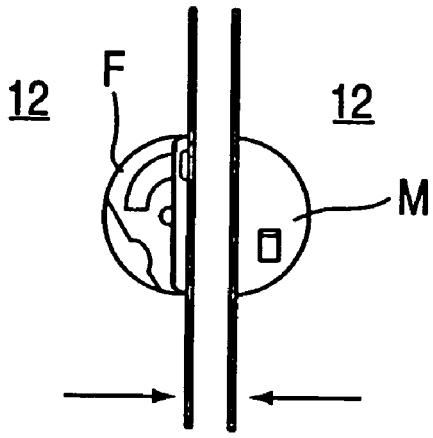
FIGS. 6-8 illustrate the steps of connecting male and female coupling members.
Figure 7:
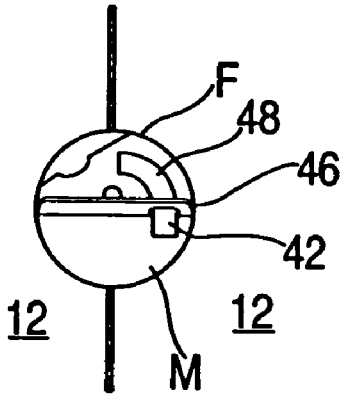
Figure 8:
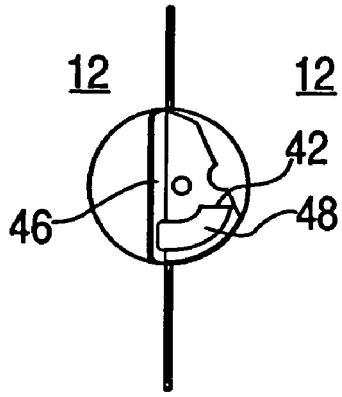

FIGS. 6-8 show how the exemplary male and female coupling members are used to connect tables to each other. As shown in FIG. 6, two table tops are brought edge to edge with male and female coupling members aligned. As shown in FIG. 7, the flange 46 of the female coupling member F is grasped with finger and thumb and twisted to cause the female coupling member to rotate with the curved slot 48 engaging the upstanding flange 42 of the male coupling member. Twisting is completed as shown in FIG. 8. The curved slot 48 may be designed to provide a camming action which forces the edges of the table tops together. It will also be appreciated that the table tops could be provided with a tongue and groove configuration to assure that the combined table tops present a smooth continuous surface.

Figure 9:
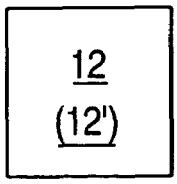
FIGS. 9-16 are schematic transparent views illustrating different configurations of connected tables.
Figure 10:
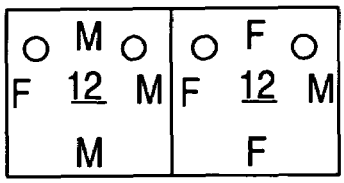
Figure 11:
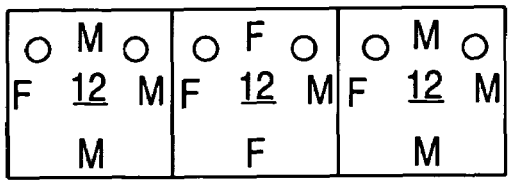
Figure 12:
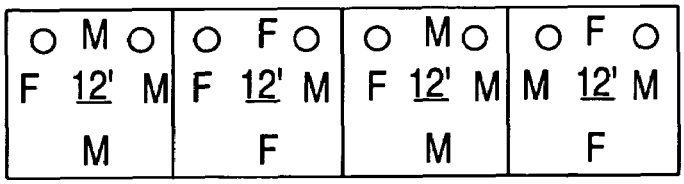
Figure 13:
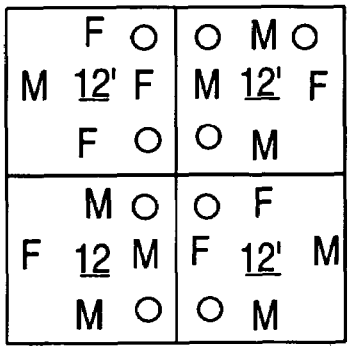
Figure 14:
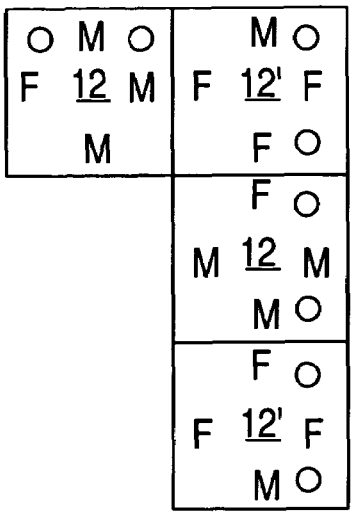
Figure 15:
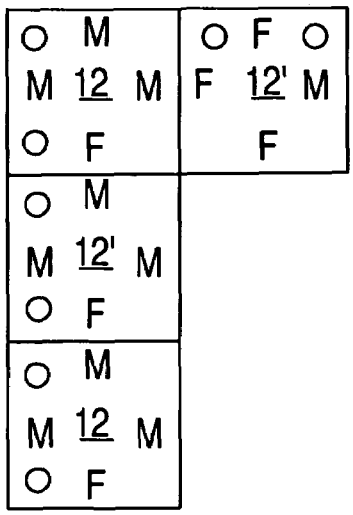
Figure 16:
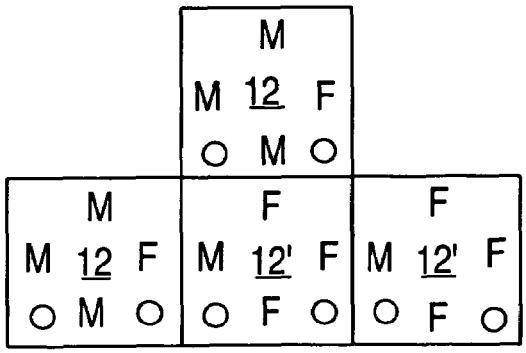

FIGS. 9-16 illustrate several ways in which the tables can be coupled to each other. These figures are schematic views of the tops of the tables with the locations of the male coupling members illustrated by M, the female couplings illustrated by F and the location of the vertical supports illustrated by O. FIG. 9 simply shows that one table of either embodiment can be used alone. FIGS. 10-12 show than an unlimited number of tables can be coupled in a row with the vertical supports all on one side to allow chairs to fit on the other side by using alternating embodiments 12, 12'. FIG. 13 shows how two tables having tops 12 and 12' can be coupled to each other and to two tables having tops 12 and 12' resulting in a square with the vertical supports of all the tables in the center close together. FIGS. 14 and 15 show left and right L-shaped configurations using two table tops 12 and two 12'. FIG. 16 shows a T-shaped configuration which is formed with two table tops of each type. It will therefore be appreciated that with a set of four tables, two of each type, all of the configurations shown in FIGS. 9-16 can be arranged.

Figure 17:
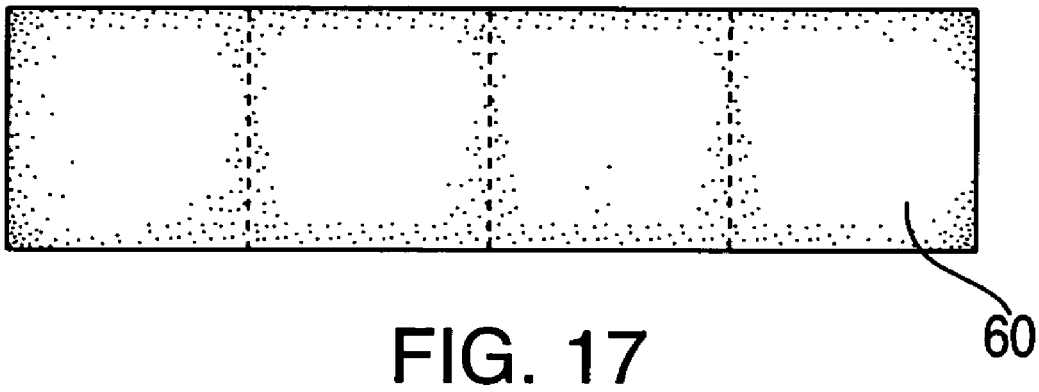
FIGS. 17 and 18 illustrate different tablecloths configured to match the table configurations of FIGS. 12 and 14 respectively.
Figure 18:
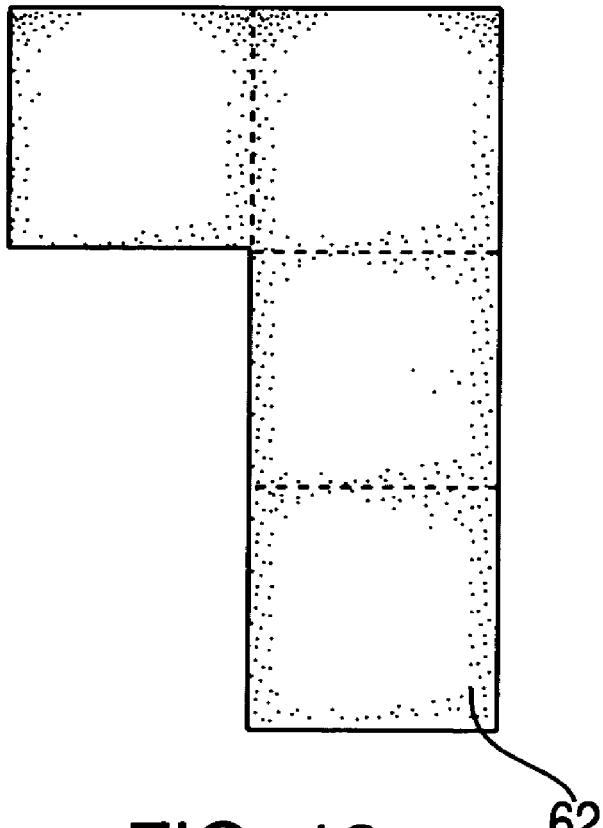

According to another aspect of the invention, the tables are packaged in a set together with a number of different table cloths, each being seamed to fit neatly over a different configuration of attached tables. Two examples of these tablecloths are shown in FIGS. 17 and 18 which respectively show a tablecloth 60 designed for the table configuration of FIG. 12 and a tablecloth 62 designed for the table configuration of FIG. 14. Of course other configurations can be used to match other table configurations.

FIGS. 19 to 27 describe the details of the latch mechanism.

In this new arrangement as illustrated in FIGS. 19-27, the latch means comprises a fixed catch 70, and a latch mechanism 72. The fixed catch 70, comprises a flat, generally elongate base plate portion 74, with two screw holes at each end by which it can be mounted via screws to the underside of a table top 12, such that it can be disposed preferably in the middle of one side of said table top. A generally hook-like end portion and, in particular, a C-shaped hook 76, depends from one of the outer edges thereof, opening away from the edge of the table.

The latch mechanism 72, comprises a latch base 78, a latch arm 80, a latch handle 82, a flange piece 84, and a spring 86. The latch base 78, includes a central raised hub 88 and two laterally extending end portions 90, in which screw holes are formed by which it can be mounted via screws to the underside of a table top such that it can be disposed preferably in the middle of one side of said table top. The central hub 88, further has a hole 91, centrally formed thereon so as to permit a pin 92, to pass through. Also formed on said central hub 88, of said latch base 78, is a generally arcuate slot 94, having two ends which extend approximately 90 degrees apart wherein one end defines an open position of said latch mechanism and wherein the other end defines a closed position of said latch mechanism. The arcuate slot end which defines the closed position has an offset slot 96, having two ends, one end defining the closed position and the other end defining the locking position.

A latch arm 80 having two ends has a hook-like end portion and, in particular, a C-shaped hook at one end 98 and is rotatably mounted on said central hub via a pin 92 extending integrally from the latch handle 82. The latch arm also has a cam follower 100 integrally formed on the bottom at the opposite end from the C-shaped hook 98 of the latch arm. Also formed in the general center of the latch arm is a slot 102 through which the pin 92 of the handle 82 passes through and through which the cam follower 104 of the handle is guided through.

The latch handle 82 has a circular base and has an elongated portion 106 extending radially outward from the circular base. On the underside and in the center of the handle is an integrally formed pin 92 which couples the latch handle 82, the latch arm 80, the latch base 78 and the flange piece 84 together. Extending radially outward from the center of the handle is a cam follower 104 which travels within the slot aperture 102 formed on the latch arm.

The spring 86 having two ends is coupled at one end to the latch base 78 via an integrally formed tab 108 and and coupled at a second end to the flange piece 84 having an upstanding flange and which is coupled to the latch base 78 via the handle pin 92.

Figures 19A, 19B, 19C:
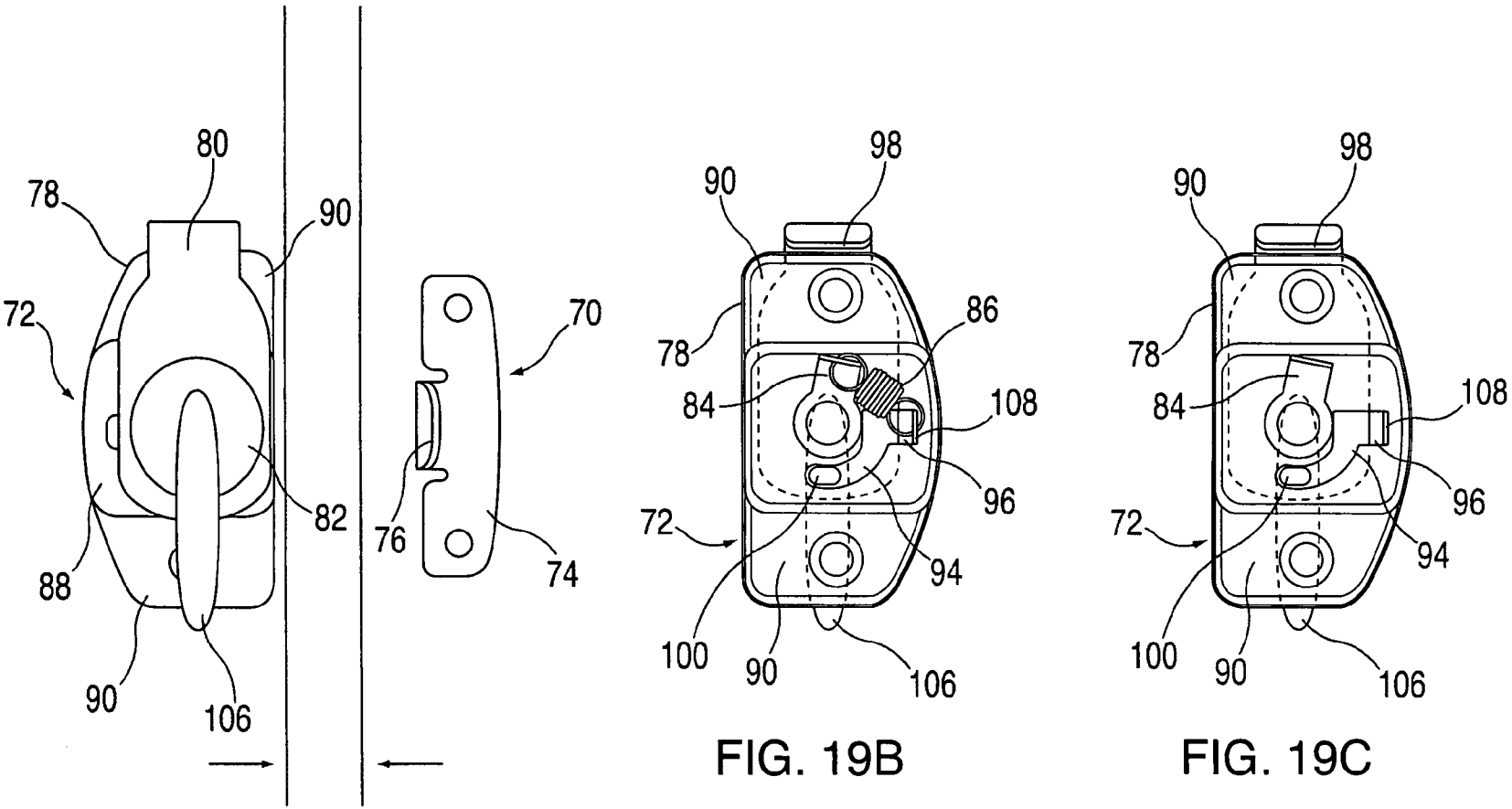
FIGS. 19 to 27 are views of an alternate embodiment of the invention.

In operation, the latch means is controlled by rotationally movement of the latch arm of the latch mechanism. As shown in FIGS. 19A, 19B and 19C, in the open position the latch arm and latch handle are parallel with the latch base. The cam follower of the latch arm that travels along the arcuate path of the latch base is at one end that defines the open position. The spring of the latch mechanism is in a fully rested position.

Figure 20C:
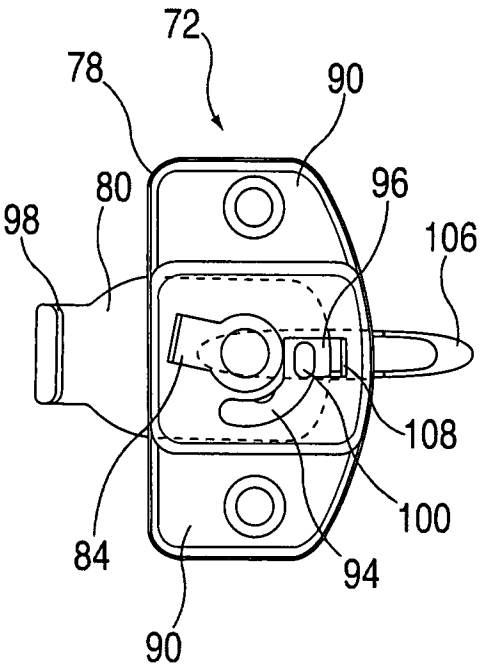
Figure 20B:
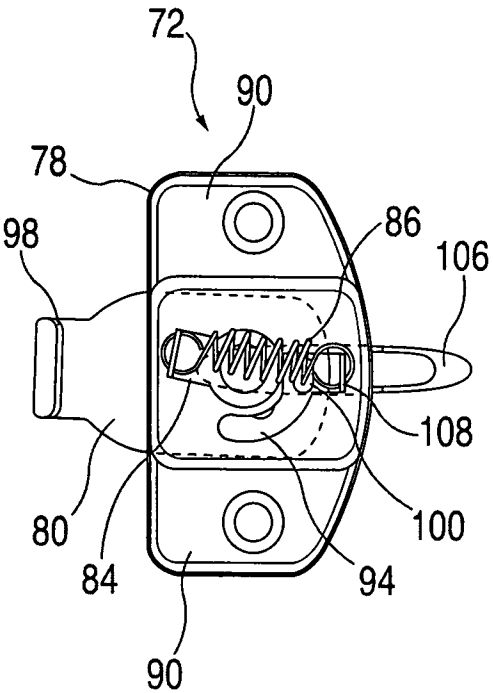
Figure 20A:
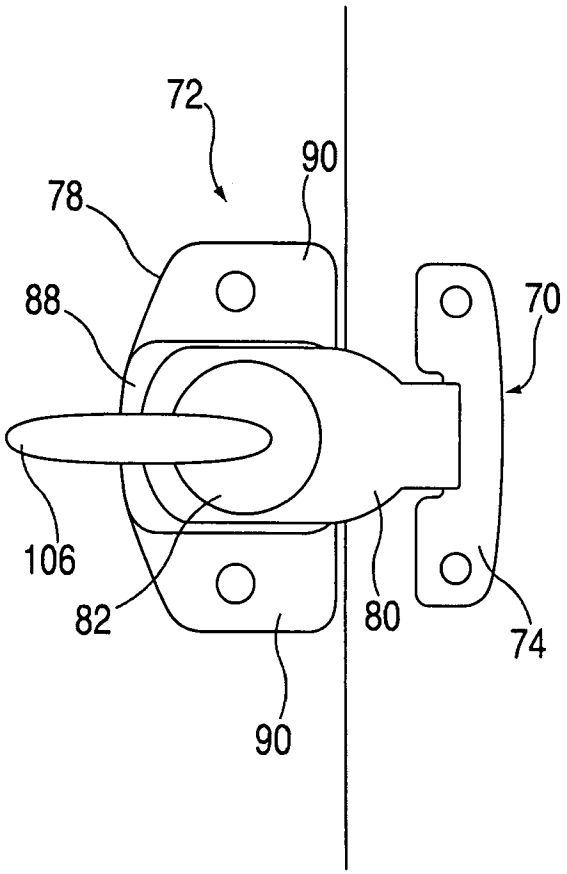

The latch handle is then turned clockwise approximately 90 degrees which in turn also moves the latch arm 90 degrees so that both latch arm and latch handle are perpendicular to the latch base so as to define a closed position, as shown in FIGS. 20A, 20B and 20C. In the closed position, the C-like hook of the latch arm overlaps the C-like hook of the catch centrally located on another table top that has been aligned with the table top of the latch mechanism and is held in place by the spring which is now fully extended. The cam follower of the latch arm is also now at the other end of the arcuate slot which defines the closed position.

Figure 21C:
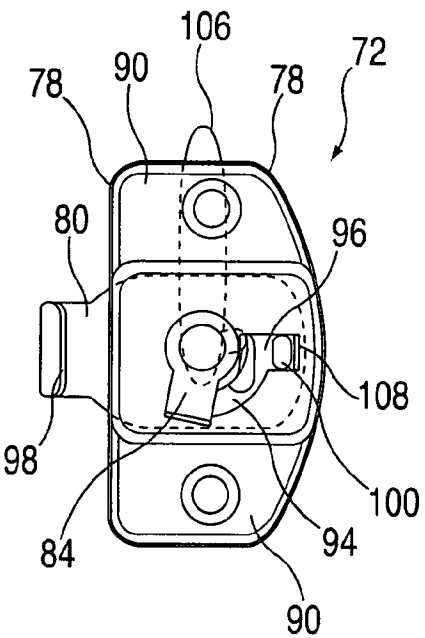
Figure 21B:
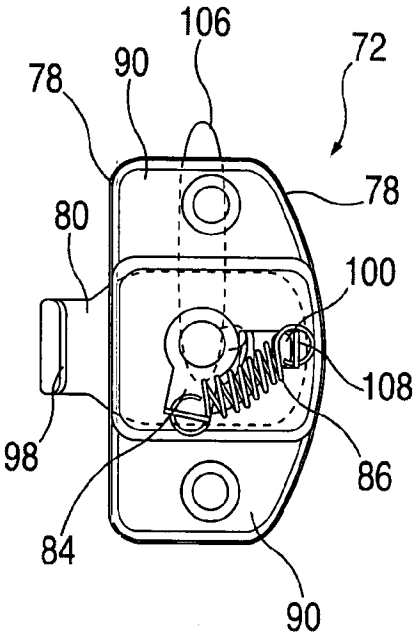
Figure 21A:
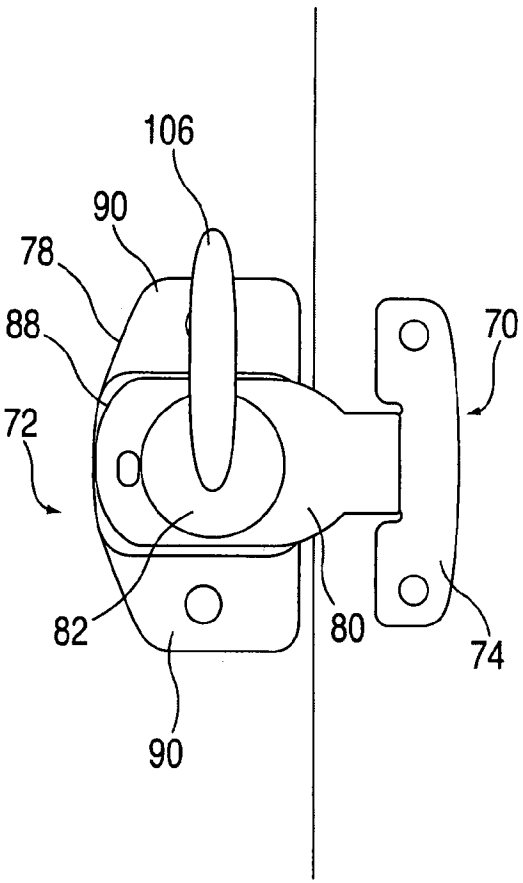
Figure 22A:
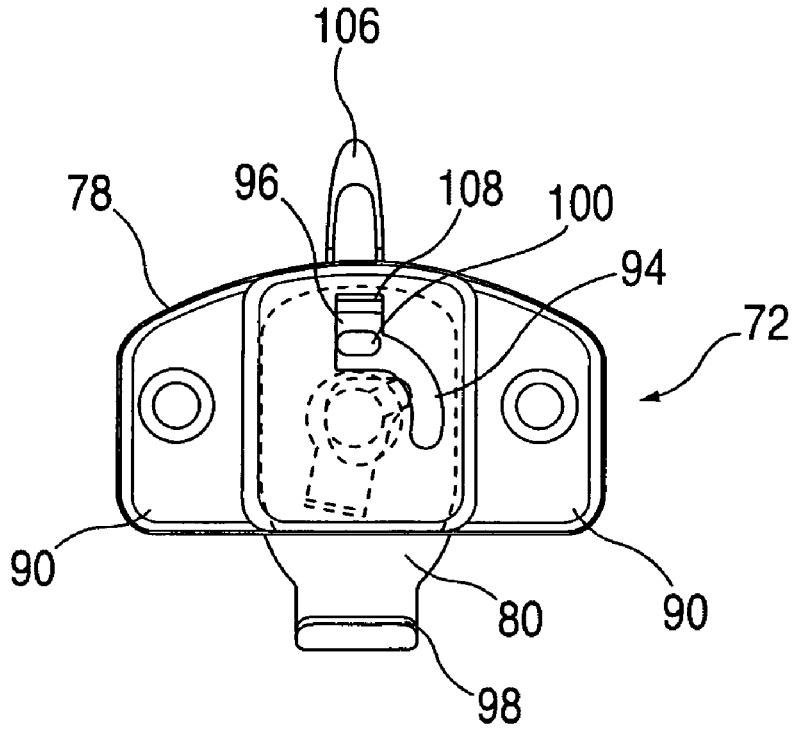
Figure 22B:
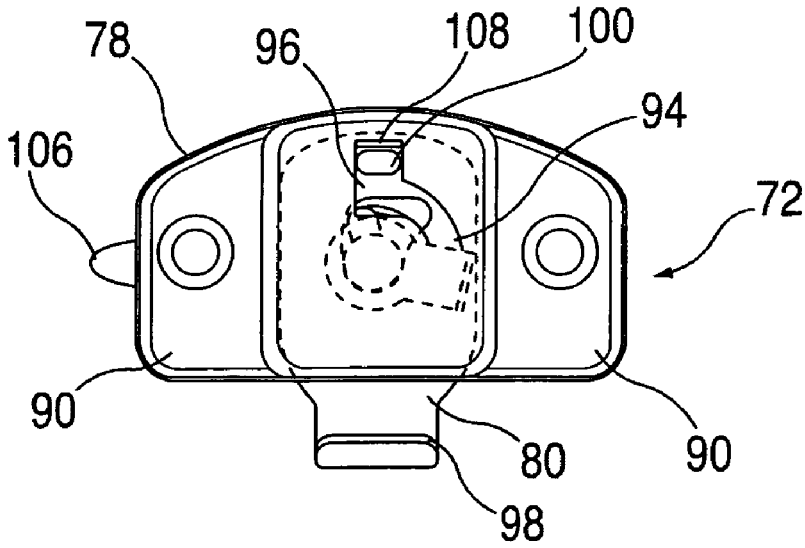
Figure 23A:
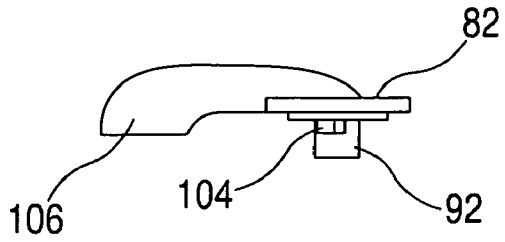
Figure 23B:
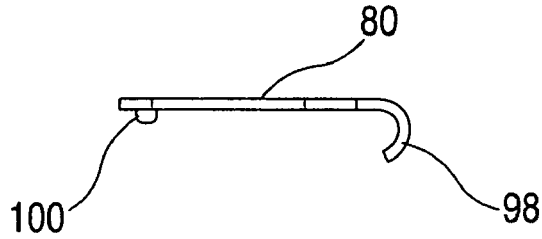
Figure 23C:
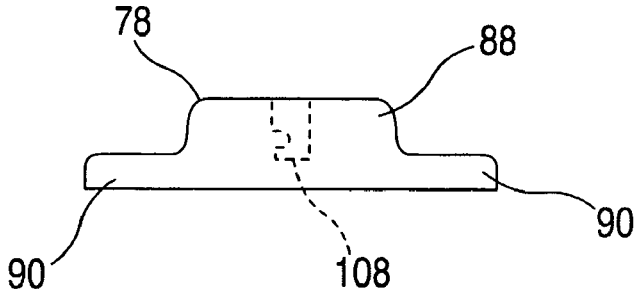
Figure 23D:
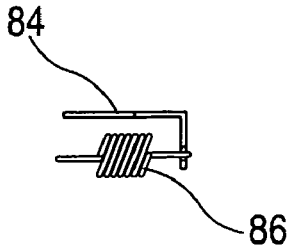
Figure 24A:
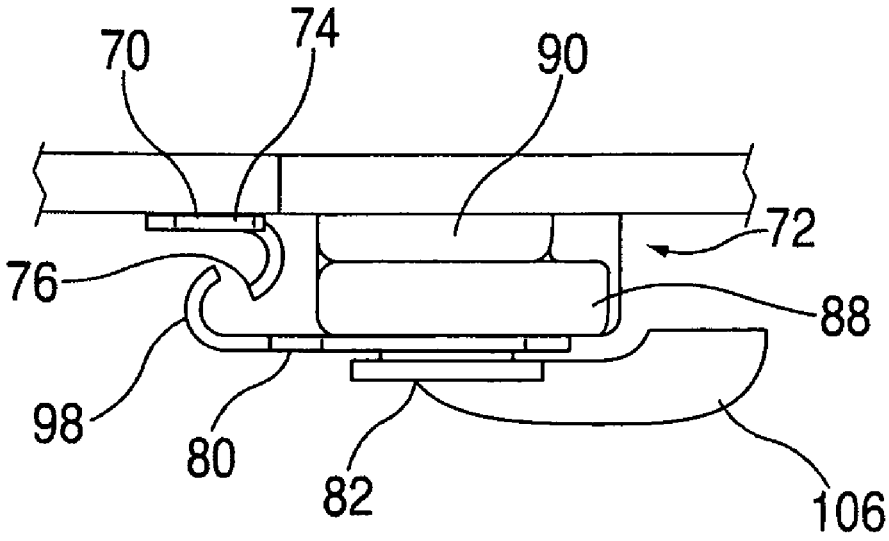
Figure 24B:
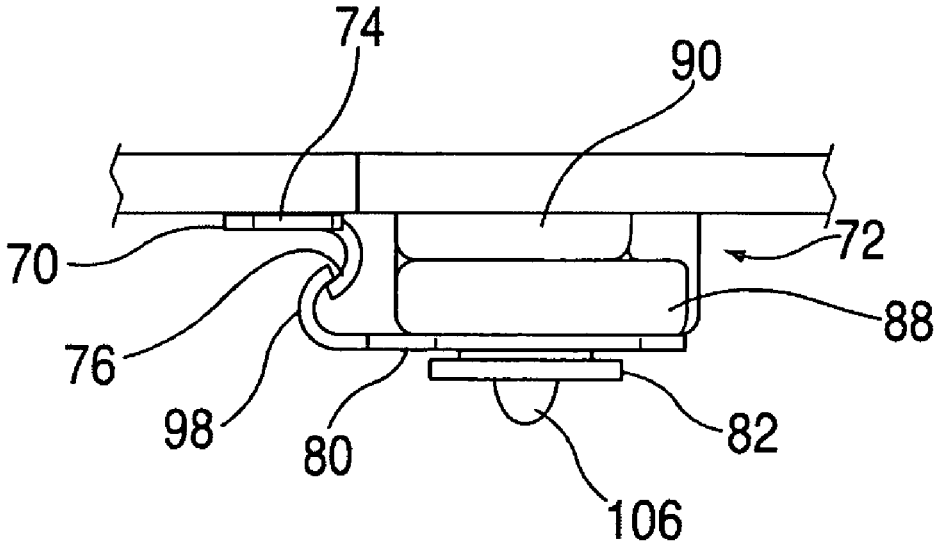
Figure 25A:
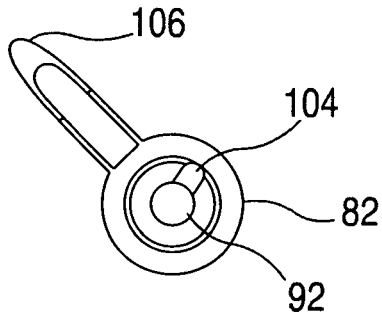
Figure 25B:
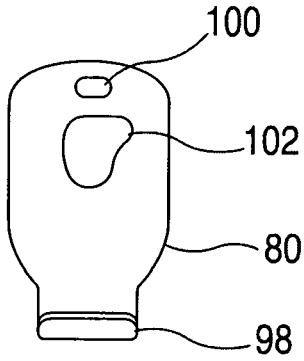
Figure 25C:
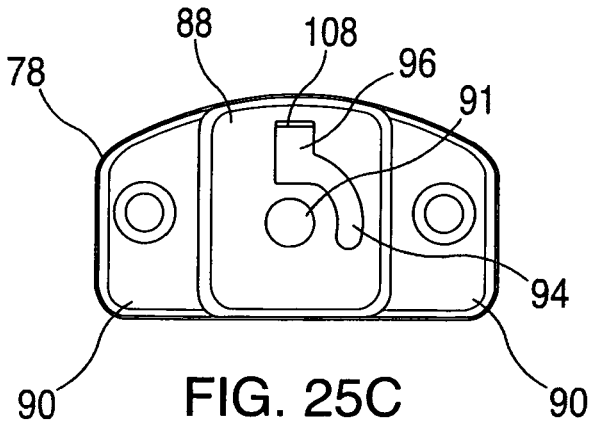
Figure 25D:
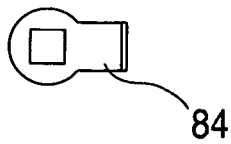
Figure 26:
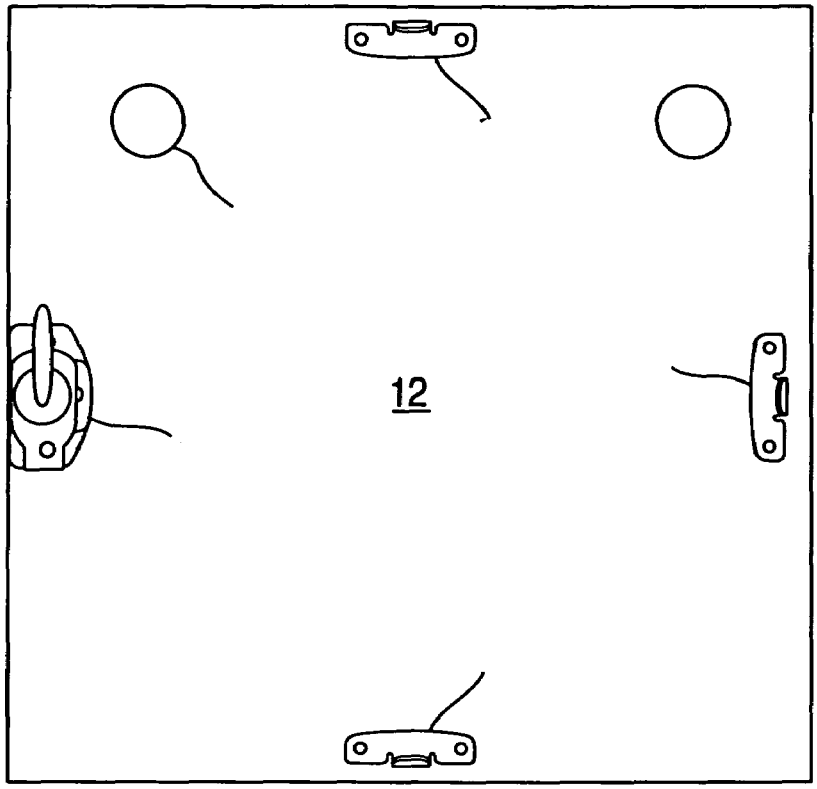
Figure 27:
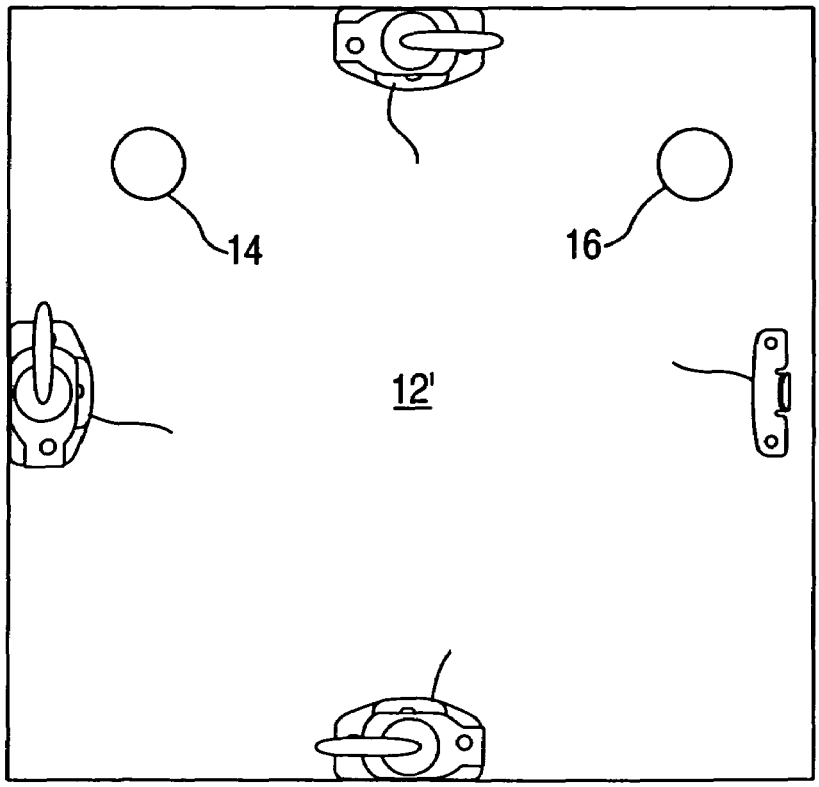

In order to place the latching mechanism in the locked position, the latch arm is turned again 90 degrees clockwise so that the latch arm is once again parallel with the latch base, although the latch arm is still perpendicular with the latch base as shown in FIGS. 21A, 21B and 21C. The latch arm is moved rearwardly away from the catch so that the C-like hook end portions grip one another due to the cam action of the cam follower of the latch handle within the slot of the latch arm. The cam follower of the latch arm has now moved into the offset slot which defines a locking position. The spring, which is now in a semi-extended state maintains the locked position.

There have been described and illustrated herein embodiments of modular folding tables. While particular embodiments of the invention have been described, it is not intended that the invention be limited thereto, as it is intended that the invention be as broad in scope as the art will allow and that the specification be read likewise. For example, although the mechanical, interlocking male-female locking means described and illustrated above are most advantageous, other locking means (e.g., Velcro fasteners) may possible by be employed to suit other applications. It will therefore be appreciated by those skilled in the art that yet other modifications could be made to the provided invention without deviating from its spirit and scope as so claimed.

What is claimed is:

1. A modular table assembly comprising:

a plurality of tables being positionable adjacent to one another so that at least one other side of one table is disposed adjacent to a side of one other said tables, each of said tables having:

a square table top having a front edge, a rear edge and two side edges;

two spaced-apart vertical supports each having a top end and a bottom end and a front side and a rear side, said top ends each being hingeably coupled to each of said table tops adjacent to, but spaced from, said rear edge thereof and an opposite side edge thereof, and a pair of spaced-apart horizontal feet each having a front end and a rear end wherein each foot is hingeably coupled to a different one of said bottom ends of said vertical supports, adjacent to, but spaced from, said rear end thereof for movement between an open position, in which said feet are horizontally disposed entirely beneath said table top for supporting said table in an upright position with said table top in a horizontally-extending position, with its rear edge extending rearwardly of said vertical supports, and a collapsed position, in which said feet are folded upwardly and abut said front side of said vertical supports and said table top is folded downwardly and abuts said front side of said vertical supports next to said folded feet but spaced therefrom to form a more compact configuration for storage, and wherein, when in said open position, said vertical supports are positioned to be connected to said feet between said ends thereof and wherein said rear ends extend outwardly and rearwardly from the location where said bottom ends of said vertical supports are coupled to said feet;

at least one first cross member coupling said vertical supports to each other;

at least one second cross member coupling said feet to each other, wherein said second cross member is connected to said feet at a location generally centrally located on said feet, between said ends of said feet, wherein a space is created forwardly of said second cross member wherein a person can sit with their legs and feet disposed beneath said table top and forwardly of said second cross member;

two pairs of folding struts, one pair coupling said vertical supports to said table top and the other pair coupling said feet to said vertical supports to permit movement of said table from said open position to said collapsed position; and only four latch means for releasably coupling a table top of one of said plurality of tables to a table top of at least one other of said plurality of tables along adjacent sides thereof, wherein a single latch means is located exactly at the center of a different side edge of said table top;

each of said latch means comprising a fixed catch mounted on one of said table tops and a movable latch mounted on an other of said table tops, said movable latch being movable between an open, closed and locking latching position relative to said fixed catch such that when in the closed and locked position said two tables are brought together with the respective edges butted together.

2. A modular table assembly according to claim 1, wherein said movable latch comprises a fixed latch base and a moveable latch arm which is movable between open, closed and locked latching positions.

3. A modular table assembly according to claim 2, wherein said movable latch arm is pivotably mounted on said latch base via a pin rotatably supported by said latch base.

4. A modular table assembly according to claim 3, wherein said movable latch further comprises a handle mounted on said pin for movement with and relative to said latch arm.

5. A modular table assembly according to claim 4, wherein said latch base has a generally arcuate slot formed therein and said latch arm has a cam follower received in said slot.

6. A modular table assembly according to claim 5, wherein said arcuate slot has two ends approximately 90° apart, one of which defines said open position and the other of which defines said closed position.

7. A modular table assembly according to claim 6, wherein said slot end defining said closed position has an offset slot in which said cam follower is movable and which defines a locked position.

8. A modular table assembly according to claim 5, wherein said fixed catch and said latch arm each have a generally C-shaped hook end portion which overlap when in said closed position.

9. A modular table assembly according to claim 8, wherein said latch arm has a cam slot and said handle has a cam follower received in said slot and movable between a closed and locking position relative to said slot, said cam follower when moved from said closed position to said locking position moving said cam follower to said latch arm into said slot so that said arm is slid rearwardly away from said catch so that said generally C-shaped hook end portions grip one another.

10. A modular table assembly according to claim 2, wherein said movable latch includes a spring having two ends, one of which is coupled to said latch base and the other of which is coupled to said latch arm, said spring being positioned to urge said latch arm into said open and closed positions.

* * * * *